US008703689B2

(12) United States Patent
Mercado

(10) Patent No.: US 8,703,689 B2
(45) Date of Patent: Apr. 22, 2014

(54) HYPOCHLORITE COMPOSITION WITH ENHANCED FABRIC AND EQUIPMENT SAFETY BENEFITS

(75) Inventor: Hedeliza Malonzo Mercado, Scarborough (CA)

(73) Assignee: KIK Custom Products Inc., Concord (CA)

( * ) Notice: Subject to any disclaimer, the term of this patent is extended or adjusted under 35 U.S.C. 154(b) by 74 days.

(21) Appl. No.: 12/981,220

(22) Filed: Dec. 29, 2010

(65) Prior Publication Data

US 2011/0088171 A1 Apr. 21, 2011

Related U.S. Application Data

(62) Division of application No. 12/358,044, filed on Jan. 22, 2009, now abandoned.

(60) Provisional application No. 61/144,301, filed on Jan. 13, 2009.

(51) Int. Cl.

| | |
|---|---|
| ***C11D 7/14*** | (2006.01) |
| ***C11D 7/28*** | (2006.01) |
| ***C11D 7/54*** | (2006.01) |

(52) U.S. Cl.

USPC ..... 510/380; 510/303; 510/350; 510/433; 510/435; 510/466; 510/503; 510/511; 252/186.34; 8/108.1

(58) Field of Classification Search

USPC ..... 510/303, 380, 350, 433, 435, 466, 503, 510/511; 252/186.34; 8/108.1

See application file for complete search history.

(56) References Cited

U.S. PATENT DOCUMENTS

| | | | | |
|---|---|---|---|---|
| 4,065,545 | A | 12/1977 | Gamlen | |
| 5,229,027 | A | 7/1993 | Ahmed | |
| 5,746,936 | A | 5/1998 | Mercado | |
| 5,843,191 | A * | 12/1998 | Agostini | 8/108.1 |
| 5,914,069 | A * | 6/1999 | Agostini et al. | 252/186.36 |
| 6,090,770 | A | 7/2000 | Mendoza et al. | |
| 6,120,555 | A * | 9/2000 | Scialla et al. | 8/108.1 |
| 6,774,098 | B2 | 8/2004 | Taylor | |
| 6,824,705 | B1 | 11/2004 | Mercado et al. | |
| 6,838,421 | B2 | 1/2005 | Mercado | |
| 6,894,015 | B1 | 5/2005 | Briatore et al. | |
| 6,946,435 | B1 | 9/2005 | Taylor | |
| 7,109,157 | B2 | 9/2006 | Taylor | |
| 7,582,595 | B1 | 9/2009 | Taylor | |
| 7,582,596 | B1 | 9/2009 | Taylor | |
| 7,582,597 | B1 | 9/2009 | Taylor | |

(Continued)

FOREIGN PATENT DOCUMENTS

EP 0 688 857 B1 12/1995

*Primary Examiner* — Gregory R Delcotto

(74) *Attorney, Agent, or Firm* — McDonnell Boehnen Hulbert & Berghoff LLP

(57) ABSTRACT

The present invention provides an aqueous bleaching composition comprising from about 1.0% to 10.0% by weight of alkali metal hypochlorite, from about 0.05% to 5.0% by weight of alkali metal hydroxide to provide the composition with a pH in the range of from about 9 to 14; from about 0.02% to 5.0% by weight of a metal silicate or mixtures of metal silicates; from about 0.0001% to 0.2% by weight of a metal periodate; and water. The compositions reliably protect the fabric against yellowing and weakening while providing protection to stainless steel metal parts of the washing machine and metal garment decors such as buckles, buttons, etc.

20 Claims, 2 Drawing Sheets

CLAMP

BUCKLE

FLANGE

(56) References Cited

U.S. PATENT DOCUMENTS

| | | | |
|---|---|---|---|
| 7,585,829 | B1 | 9/2009 | Taylor |
| 7,628,822 | B2 | 12/2009 | Taylor |
| 2004/0023837 | A1 | 2/2004 | Zanardi et al. |
| 2007/0027054 | A1 | 2/2007 | Briatore et al. |
| 2007/0287651 | A1 | 12/2007 | Sarcinelli et al. |

* cited by examiner

CLAMP

BUCKLE

FLANGE

CLAMP

BUCKLE

FLANGE

CLAMP

BUCKLE

FLANGE

CLAMP

BUCKLE

FLANGE

CLAMP

BUCKLE

FLANGE

HYPOCHLORITE COMPOSITION WITH ENHANCED FABRIC AND EQUIPMENT SAFETY BENEFITS

CROSS-REFERENCE TO RELATED APPLICATION

This application is a divisional of U.S. patent application Ser. No. 12/358,044, filed Jan. 22, 2009, now abandoned, which claims priority to U.S. Provisional Patent Application Ser. No. 61/144,301, filed Jan. 13, 2009, the contents of which are incorporated by reference in its entirety.

FIELD OF THE INVENTION

This invention relates to a liquid bleaching composition that is suitable for laundry and household application and that is particularly suitable as a pre-wash in laundry applications including hand washing and washing with automatic washing machines.

BACKGROUND OF THE INVENTION

Numerous liquid bleaching compositions containing hypochlorite are well-known in the art. They have been extensively described to help with the removal of "problem" stains, such as coffee, tea, grass and red wines that are very difficult to remove from garments by ordinary washing, either by hand or with the use of a washing machine.

However, hypochlorite-containing bleaching compositions may cause yellowing and damage to fabrics being washed. Also, such compositions may cause corrosion to metallic decorations on the garments, such as buttons, buckles, etc. These compositions also may cause damage to the stainless steel or other metallic parts of washing machines, especially when the compositions are used in pre-treatment applications under stressed condition, for example, during soaking of garments for extended periods of time using the drum of the washing machines, or when applied onto the garments and left to act on the garments for an extended time period before washing of the garments.

In one aspect of the present invention, there is provided a hypochlorite-containing bleaching composition suitable for laundry application that enhances fabric whiteness.

In a further aspect of the present invention, there is provided a hypochlorite-containing bleaching composition suitable for laundry application that reduces fabric damage caused by conventional hypochlorite compositions.

In yet a further aspect of the present invention, a hypochlorite-containing bleaching composition is provided that is suitable for laundry application wherein the composition provides protection to stainless steel and other metallic parts of washing machines, as well as to metallic garment decors.

U.S. Pat. No. 6,946,435 B1 discloses a bleaching composition comprising hypochlorite and increased sodium hydroxide to remove menstrual fluid, underarm perspiration or hard-to-remove stains.

U.S. Pat. No. 7,109,157 B2 discloses a bleaching composition the same as the above but with added reduced damage to the fabric benefit when compared with popular chlorine bleaches.

U.S. Pat. No. 6,090,770 discloses a bleaching composition containing hypochlorite, alkali hydroxide, silicate and phosphoric and/or phosphonate to protect the textiles treated against encrustation and yellowing, even in the presence of water hardness and heavy metal ions.

U.S. Pat. No. 5,746,936 discloses a bleaching composition comprising hypochlorite, metal carbonate, metal hydroxide and alkali metal phosphate to enhance fabric whitening and/or provide safety benefits.

U.S. Pat. No. 6,153,120 discloses a bleaching composition containing hypochlorite, hydroxide, carbonate, silicates, borate and mixtures thereof and a polymer to prevent the precipitation of the buffering salt to improve fabric whiteness and safety.

U.S. Pat. No. 5,130,043 discloses thickened aqueous automatic dishwashing detergent compositions of which silicate is present at 4% to 10%, polycarboxylate polymers and phosphate esters having enhanced stability and cohesiveness.

U.S. Pat. No. 4,741,858 discloses time-release bleaching compounds containing sodium-silicate coated hypochlorite to reduce fabric and dye damage in fabric bleaching while facilitating the inclusion of optical laundry additives such as enzymes and brighteners.

U.S. Pat. No. 5,567,247 discloses a concentrated cleaning composition for cleaning outdoor surfaces containing chlorinated bleach solution, surfactant, phosphate and silicate.

U.S. Pat. No. 5,843,190 discloses an aqueous liquid bleaching composition having improved whitening and fabric safety performance consisting of an alkali metal hypochlorite, an alkali metal silicate, a strong source of alkalinity and an alkali metal carbonate. U.S. Pat. No. 5,843,191 discloses a similar composition except that the level of hypochlorite is from 0.0015% to 0.5% by weight.

U.S. Pat. No. 5,236,614 discloses a stable microemulsion detergent composition that includes hypochlorite, higher alcohol sulfate, higher paraffin sulfonate detergents, higher fatty acid soap, alkali metal hydroxide, perfume, branched lower alcohol co-surfactant and periodate.

While several hypochlorite-containing bleaching compositions have been described in the prior art for laundry applications, the advantage with the use of silicate and periodate to provide enhanced fabric and equipment safety have not been recognized until now.

SUMMARY OF THE INVENTION

Accordingly, one aspect of the present invention provides an aqueous liquid bleaching composition that is preferably suitable for fabric and household surface cleaning and particularly suitable as a pre-wash and laundering composition to provide whitening, fabric and equipment safety benefits. The aqueous liquid bleaching composition comprises:

(a) an alkali metal hypochlorite;
(b) a source of alkalinity, such as an alkali metal hydroxide, to provide the composition with a pH in the range of 9 to 14;
(c) a metal silicate; and
(d) a metal periodate.

In particular, the aqueous liquid bleaching composition is suitable for fabric and household surface cleaning and comprises:

(a) from about 1.0% to 10.0% by weight of alkali metal hypochlorite,
(b) from about 0.05% to 5.0% by weight of alkali metal hydroxide to provide the composition with a pH in the range of from about 9 to 14;
(c) from about 0.02% to 5.0% by weight of a metal silicate or mixtures of metal silicates;
(d) from about 0.0001% to 0.2% by weight of a metal periodate; and
(e) water.

The aqueous liquid bleaching composition of this aspect of the present invention provides improved fabric whitening, reduced fabric damage and enhanced protection for the metallic parts of the washing machines as well as any metallic garment decors such as buckles, buttons, belts, etc. relative to the performance of conventional bleaching compositions that are commercially available.

In a preferred embodiment, the metal periodate may be added as an alkali metal periodate, such as sodium or potassium periodate, or may be formed in situ by the reaction of an alkali metal iodide and iodine to form the alkali metal periodate.

In a further aspect, the present invention provides a method of bleaching or washing fabrics comprising the step of contacting fabrics with an aqueous liquid bleaching composition that enhances the delivery of whitening, fabric and equipment safety benefits, wherein the composition comprises:

(a) from about 1.0% to 10.0% by weight of alkali metal hypochlorite,
(b) from about 0.05% to 5.0% by weight of alkali metal hydroxide to provide the composition with a pH in the range of from about 9 to 14;
(c) from about 0.02% to 5.0% by weight of a metal silicate or mixtures of metal silicates;
(d) from about 0.0001% to 0.2% by weight of a metal periodate; and
(e) water.

One preferred way to carry out the method of the present invention is to contact the fabrics with the said bleaching composition to bleach the fabrics, followed by the step of rinsing the bleached fabrics to substantially remove any residual bleaching solution from the fabrics before any detergent washing steps. The contact time of the fabrics with the bleaching composition to effect the desired bleaching and washing is preferably from about 3 to 60 minutes, most preferably from 5 to 30 minutes.

DETAILED DESCRIPTION OF THE INVENTION

Figure 1:
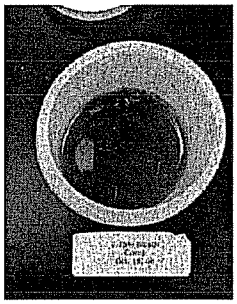
FIG. 1 are pictures showing the results of the tests described in Example 1 for Composition 1.
Figure 1:
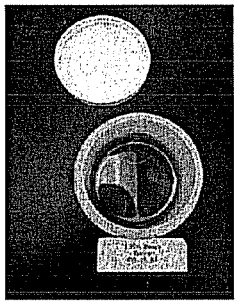
Figure 1:
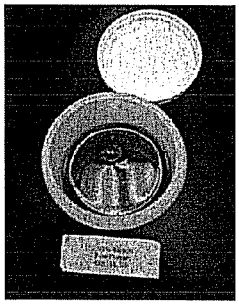

One aspect of the present invention relates to an aqueous liquid bleaching composition comprising the following components, in addition to optional fragrance ingredients:

(a) from about 1.0% to 10.0% by weight of alkali metal hypochlorite,
(b) from about 0.05% to 5.0% by weight of alkali metal hydroxide to provide the composition with a pH in the range of from about 9 to 14;
(c) from about 0.02% to 5.0% by weight of a metal silicate or mixtures of metal silicates;
(d) from about 0.0001% to 0.2% by weight of a metal periodate; and
(e) water.

Surprisingly, it has been found that the incorporation of metal silicate and metal periodate into the aqueous liquid bleaching composition significantly improves the fabric whitening performance, and reduces fabric and equipment damage relative to the use of conventional hypochlorite containing bleach compositions.

The first component of the aqueous liquid bleaching composition is an alkali metal hypochlorite. While various forms of alkali metal hypochlorite are available in the trade, the preferred form is sodium hypochlorite, although the use of this particular form is not critical to the aqueous liquid bleaching composition. The preferred aqueous liquid bleaching composition comprises from about 1.5% to 7.0% by weight of alkali metal hypochlorite based on active chlorine, and more preferably from about 2.0% to 6% by weight of alkali metal hypochlorite based on active chlorine.

The second component of the aqueous liquid bleaching composition is an alkali metal hydroxide as a source of alkalinity. The alkali metal hydroxide is generally understood to be sodium and/or potassium hydroxide added over and above the excess alkalinity present in the hypochlorite bleach. The preferred aqueous liquid bleaching composition comprises from about 0.1% to 2.5% by weight of the total composition of the alkali metal hydroxide, and more preferably from 0.2% to 1.5% by weight of the total composition. The pH of the aqueous liquid bleaching composition is from about 9 to 14, preferably from 10 to 13.5 and most preferably from 12 to 13.5.

The third component of the aqueous liquid bleaching composition is a metal silicate. Examples of suitable alkali metal or alkaline earth metal silicates include sodium and/or potassium silicates or a combination thereof. The ratio of the metal oxide to $SiO_2$ can range from about 1:1 to 1:3.2. Preferably, the amount of metal silicate in the aqueous liquid bleaching composition is from about 0.1% to 2.5% by weight, and most preferably from about 0.2% to 1.5% by weight.

The fourth component of the aqueous liquid bleaching composition is a metal periodate that may be added as an alkali metal periodate to the composition, such as sodium or potassium periodate, or that may be formed in situ by the reaction of an alkali metal iodide and iodine to form the metal periodate in the presence of alkaline hypochlorite solution.

In an alkaline solution, the silicate acts as a buffer to maintain the pH of the solution such that the dissociation of hypochlorite bleach into hypochlorous acid is reduced, thereby reducing the yellowing of garments, and reducing damage caused to fabric and equipment.

The periodate surprisingly improves the enhancement of the whitening effect and reduces the damaging effect caused by the hypochlorite. It has been found that the stabilizing effect of periodate on hypochlorite reduces the amount of hypochlorous acid generated, especially in the presence of heavy metals in the wash solution.

In addition, as an optional ingredient, the aqueous liquid bleaching composition may also contain hypochlorite-compatible fragrances. The fragrances may be added either directly to the composition, or as an emulsified solution. When the fragrances are added as an emulsified solution, the surfactant used in the emulsified solution should be compatible with hypochlorite. An example of such a compatible surfactant is amine oxide having general formula (I):

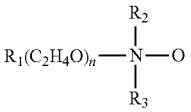

(I)

wherein:

$R_1$ is an alkyl, 2-hydroxyalkyl, 3-hydroxyalkyl, or 3-alkoxy-2-hydroxypropyl radical in which the alkyl and alkoxy, respectively, contain from 8 to 18 carbon atoms, R2 and R3 are each methyl, ethyl, propyl, isopropyl, 2-hydroxyethyl, 2-hydroxypropyl, or 3-hydroxypropyl, and n is an integer from 0 to 10.

The balance of the aqueous liquid bleaching composition is water to achieve a 100% by weight composition.

In use, the aqueous liquid bleaching composition of the present invention is preferably first diluted in amounts in the range of from about 0.5 g/l to 140 g/l, preferably from about 1 g/l to 50 g/l, and most preferably from about 5 g/l to 25 g/l. The fabrics to be bleached are then contacted the bleaching composition (whether diluted or not) for a period of from about 3 to 60 minutes, preferably 5 to 30 minutes. Following this, the fabrics are preferably rinsed to substantially remove any bleaching composition from the fabrics, and the fabrics may then be washed with a detergent solution.

EXAMPLES

Example 1

To evaluate equipment and fabric metal safety benefits, four bleaching compositions were prepared having the compositions listed in Table 1, below. Clorox HE Bleach that is currently available in the US market was also included in this evaluation.

TABLE 1

| | Composition 1 Weight % | Composition 2 Weight % | Composition 3 Weight % | Composition 4 Weight % |
|---|---|---|---|---|
| NaOCl | 2.75 | 2.75 | 2.75 | 2.75 |
| NaOH | 0.0 | 0.6 | 0.6 | 0.6 |
| Sod. Silicate | 0.0 | 0.2 | 0.0 | 0.0 |
| Sod. Periodate | 0.0 | 0.002 | 0.002 | 0.0 |
| Water and other adjuvants | To 100 | To 100 | To 100 | To 100 |

The test condition that was followed consists of soaking stainless materials and a buckle in each of the bleach compositions for 1 hour at 40° C., and then the materials and buckles were left in contact with the bleach composition for 15 days at room temperature. At the end of the 15-day period, pictures of the materials and buckles were taken. The materials and buckles used in this evaluation were:

Stainless steel clamp code number 63-2106-8

Belt buckle sku 001949521

Stainless steel pipe flanges M6490

Figure 2:
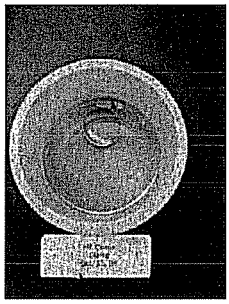
FIG. 2 are pictures showing the results of the tests described in Example 1 for HE Clorox (Commercially Marketed in the US).
Figure 2:
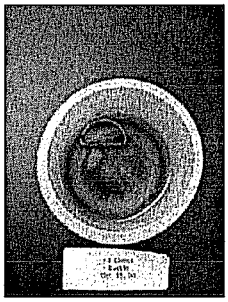
Figure 2:
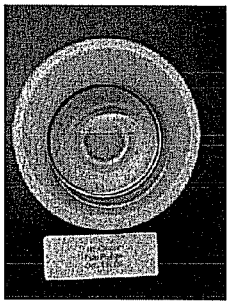
Figure 3:
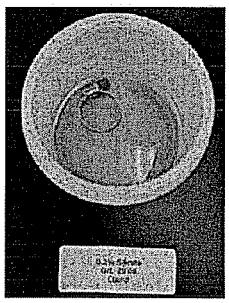
FIG. 3 are pictures showing the results of the tests described in Example 1 for Composition 2.
Figure 3:
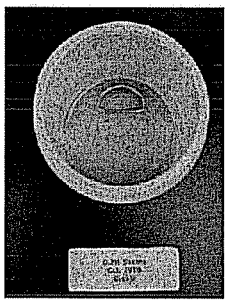
Figure 3:
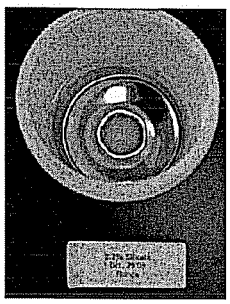
Figure 4:
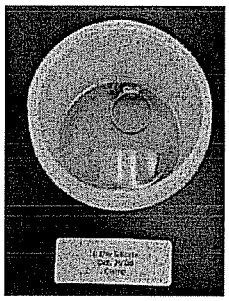
FIG. 4 are pictures showing the results of the tests described in Example 1 for Composition 3.
Figure 4:
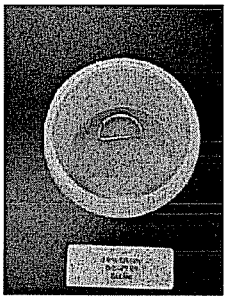
Figure 4:
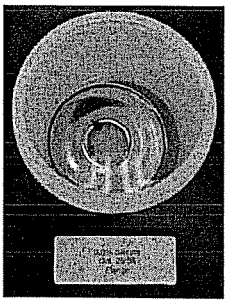
Figure 5:
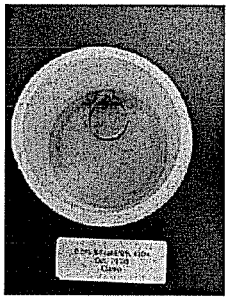
FIG. 5 are pictures showing the results of the tests described in Example 1 for Composition 4.
Figure 5:
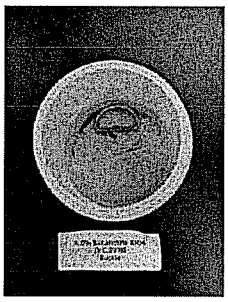
Figure 5:
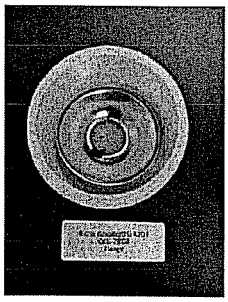

Results are shown in the pictures in FIGS. 1 to 5. Bleach composition 2, that included the addition of metal silicate and metal periodate, provided enhanced protection for the metallic parts relative to the performance of conventional bleaching compositions that are free of metal silicate and metal periodate.

Example 2

Five bleaching compositions were prepared as shown below, Table 2. Compositions D and E represent bleach composition available commercially.

TABLE 2

| | Composition A Weight % | Composition B Weight % | Composition C Weight % | Composition D Weight % | Composition E Weight % |
|---|---|---|---|---|---|
| NaOCl | 2.75 | 2.75 | 2.75 | 2.75 | 6.28 |
| NaOH | 0.6 | 0.6 | 0.6 | 0.0 | 0.0 |
| Sod. Silicate | 0.2 | 0.2 | 0.0 | 0.0 | 0.0 |
| Sod. Periodate | 0.002 | 0.0 | 0.0 | 0.0 | 0.0 |
| Water and other adjuvants | To 100 | To 100 | To 100 | To 100 | To 100 |

Eight sets of cloth of 100% white cotton material with different texture and thickness were used using the test conditions described below.

Test Condition: a 6 cycle soaking/rinsing process at 40° C. using tap water containing 2 ppm Fe and 1.5 ppm Cu to simulate aggressive conditions. Soaking was done for 30 minutes. A rinsing step followed each soaking step and was done for 2 minutes. At the end of the 6th cycle, the cloths were air dried and ironed.

The eight sets of 100% white cloth were assessed on whiteness/fabric safety by a panel of 20 members to compare the five bleach compositions described in Table 2. The results are shown below in Table 3.

TABLE 3

| | Mean* | A versus B** | A versus C** | A versus D** | A versus E** |
|---|---|---|---|---|---|
| Composition A | 96.8 | | | | |
| Composition B | 60.5 | Significant at 99% | | | |
| Composition C | 64.4 | | Significant at 99% | | |
| Composition D | 49.5 | | | Significant at 99% | |
| Composition E | 9.0 | | | | Significant at 99% |

*100 rating means whitest; 0 rating means most yellow

**Based on Student's t-Test, one tail

As can be seen above, bleach composition A, which is an embodiment of the compositions of the present invention, provided superior and unexpected whiteness improvement over the other bleach compositions tested. Bleach composition A prevented the yellowing damaging effect caused by the other bleach compositions tested. Bleach composition A is the only composition of the five tested that contained the combination of a metal silicate and a metal periodate.

The invention claimed is:

1. A method of reducing damage to metal parts of a washing machine during a laundry cycle using a hypochlorite-containing bleach, the method comprising the step of adding to said laundry cycle an aqueous liquid bleaching composition consisting essentially of:

i. from about 1.0% to 10.0% by weight of alkali metal hypochlorite, ii. from about 0.05% to 5.0% by weight of alkali metal hydroxide to provide the composition with a pH in the range of from about 9 to 14;

iii. from about 0.02% to 5.0% by weight of an alkali metal silicate or mixtures of alkali metal silicates;

iv. from about 0.0001% to 0.1% by weight of an alkali metal periodate;

v. water, and vi. optionally a fragrance wherein the fragrance either is added directly to the composition or is added as an emulsified solution wherein the emulsified solution optionally contains a surfactant that is compatible with hypochlorite, wherein the presence of said bleaching composition during said laundry cycle does not cause damage to metal parts of the washing machine with which it comes into contact.

2. The method of claim 1, comprising the further step of washing the fabrics with a detergent.

3. The method of claim 2, wherein said detergent is present in said washing machine during said contacting step.

4. The method of claim 2 wherein said bleaching composition is rinsed from said fabrics prior to the step of washing the fabrics with a detergent solution.

5. The method of claim 1, wherein the fabrics are contacted with the bleaching composition for a period of from about 3 to 60 minutes.

6. The method of claim 5, wherein the fabrics are contacted with the bleaching composition for a period of from about 5 to 30 minutes.

7. The method of claim 1, comprising the further step of diluting the bleaching composition in water.

8. The method of claim 7 wherein said bleaching composition is diluted in the range of from about 0.5 g/l to 140 g/l.

9. The method of claim 7 wherein said bleaching composition is diluted in the range of from about 1 g/l to 50 g/l.

10. The method of claim 7 wherein said bleaching composition is diluted in the range of from about 5 g/l to 25 g/l.

11. The method of claim 1 wherein the contacting step is conducted at a temperature of 40° C.

12. The method of claim 1 wherein the contacting step is conducted at room temperature.

13. The method of claim 1 wherein said fabrics have metal accessories attached thereto, which metal accessories are not damaged by contact with said bleaching composition during said contacting step.

14. A method of bleaching one or more fabrics having one or more metal accessories attached thereto while protecting said metal accessories from bleach damage, the method comprising the step of contacting the fabrics and the metal accessories attached thereto with an aqueous liquid bleaching composition consisting essentially of:

i. from about 1.0% to 10.0% by weight of alkali metal hypochlorite, ii. from about 0.05% to 5.0% by weight of alkali metal hydroxide to provide the composition with a pH in the range of from about 9 to 14;

iii. from about 0.02% to 5.0% by weight of an alkali a metal silicate or mixtures of alkali metal silicates;

iv. from about 0.0001% to 0.1% by weight of an alkali a metal periodate;

v. water, and vi. optionally a fragrance wherein the fragrance either is added directly to the composition or is added as an emulsified solution wherein the emulsified solution optionally contains a surfactant that is compatible with hypochlorite, wherein said bleaching composition does not cause damage to said metal accessories with which it comes into contact.

15. The method of claim 14, further comprising the step of diluting the bleaching composition in water.

16. The method of claim 15 wherein said bleaching composition is diluted in the range of from about 0.5 g/l to 140 g/l.

17. The method of claim 15 wherein said bleaching composition is diluted in the range of from about 1 g/l to 50 g/l.

18. The method of claim 15 wherein said bleaching composition is diluted in the range of from about 5 g/l to 25 g/l.

19. The method of claim 14 wherein the contacting step is conducted at a temperature of 40° C.

20. The method of claim 14 wherein the contacting step is conducted at room temperature.

* * * * *